US009444202B2

(12) United States Patent
Chien et al.

(10) Patent No.: US 9,444,202 B2
(45) **Date of Patent: *Sep. 13, 2016**

(54) CONNECTOR RECEPTACLE

(71) Applicant: ADVANCED-CONNECTEK INC., New Taipei (TW)

(72) Inventors: Min-Lung Chien, New Taipei (TW); Ming-Yung Chang, New Taipei (TW); Yun-Jhong Wong, New Taipei (TW); Cheng-Che Tsai, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/879,642

(22) Filed: Oct. 9, 2015

(65) Prior Publication Data

US 2016/0036177 A1 Feb. 4, 2016

Related U.S. Application Data

(63) Continuation-in-part of application No. 14/045,067, filed on Oct. 3, 2013, now Pat. No. 9,190,765.

(30) Foreign Application Priority Data

Oct. 4, 2012 (TW) ..... 101219238 U

(51) Int. Cl.

| | |
|---|---|
| ***H01R 13/648*** | (2006.01) |
| ***H01R 24/62*** | (2011.01) |
| ***H01R 13/6581*** | (2011.01) |
| *H01R 107/00* | (2006.01) |
| *H01R 12/72* | (2011.01) |
| *H01R 13/405* | (2006.01) |

(52) U.S. Cl.

CPC ..... *H01R 24/62* (2013.01); *H01R 13/6581* (2013.01); *H01R 12/725* (2013.01); *H01R 13/405* (2013.01); *H01R 2107/00* (2013.01)

(58) Field of Classification Search

CPC ..... H01R 13/506; H01R 13/658; H01R 13/65802; H01R 23/7073

USPC ..... 439/607.27, 607.04, 607.45, 607.55

See application file for complete search history.

(56) References Cited

U.S. PATENT DOCUMENTS

| | | | | |
|---|---|---|---|---|
| 7,351,106 | B2 | 4/2008 | Zhu et al. | |
| 7,422,475 | B2 * | 9/2008 | Hirata | H01R 12/727 439/541.5 |
| 7,682,199 | B2 * | 3/2010 | Ahn | H01R 24/62 439/660 |
| 7,690,948 | B2 | 4/2010 | Lung | |
| 7,753,732 | B2 | 7/2010 | Kameyama et al. | |
| 8,690,605 | B2 * | 4/2014 | Wang | H01R 13/504 439/607.27 |
| 8,690,608 | B2 | 4/2014 | Naito et al. | |
| 9,190,765 | B2 * | 11/2015 | Chang | H01R 13/6581 |

* cited by examiner

*Primary Examiner* — Hien Vu

(74) *Attorney, Agent, or Firm* — Rabin & Berdo, P.C.

(57) ABSTRACT

A connector receptacle includes an insulating housing, a plurality of contacts, a protective plate, and a metallic shell. The insulating housing includes a base portion and a tongue portion extending from the base portion. The tongue portion defines a plurality of receiving slots through the base portion. The contacts are inserted into the receiving slots, and a power contact exists among the contacts. The protective plate includes a planner main portion and two connecting arm portions. The planar main portion is disposed on the tongue portion, and includes a planar section, a front section, a side section, and a connecting section. One lateral side of the planar section is a cutting notch exposing parts of the tongue portion which corresponds to the power contact. The cutting notch prevents the power contact and the protective plate from contacting while connecting with a plug, so as to secure the safety.

10 Claims, 9 Drawing Sheets

CONNECTOR RECEPTACLE

CROSS-REFERENCES TO RELATED APPLICATIONS

This application is a continuation-in-part (CIP) of application Ser. No. 14/045,067, filed on Oct. 3, 2013 with claiming foreign priority of TW 101219238. The prior application is herewith incorporated by reference in its entirety.

BACKGROUND

1. Technical Field

The instant disclosure relates to a connector receptacle, and more particularly to a connector receptacle capable of protecting a tongue portion of an insulating housing, enforcing rigidity of the tongue portion of the insulating housing, and preventing the connector receptacle from breakdown.

2. Related Art

A Universal Serial Bus (USB) connector, generally called a USB connector, has been widely used in signal transmission on various occasions due to its characteristics such as plug and play and fast transmission speed, and with the development of the USB connector, people have more demands for the transmission speed and stability.

USB 2.0 has been mostly used as a transmission interface at present, and with the increasing popularity of digital multimedia and continuous expansion of transfer files, USB 2.0 cannot meet the market demand. USB 3.0 has characteristics of backward compatibility, and has ease of use and the plug and play function of the traditional USB technology, the goal of the technology is to put forward products with a connection level more than 10 times faster than the current connection level, which uses the same architecture as the existing USB, in addition to optimizing the USB, to achieve lower power consumption and higher protocol efficiency, and supports future optical fiber transmission, and compared with the transmission speed of 480 Mbps of USB 2.0, the transmission speed of USB 3.0 may be up to 5 Gbps.

The existing USB connector receptacle structure mainly includes: an insulating housing, a plurality of contacts, and a metallic shell. The insulating housing includes a base portion and a tongue portion extending forward from the base portion, where the tongue portion is provided with receiving slots through the base portion. The contacts are inserted into the receiving slots of the insulating housing. The metallic shell wraps the insulating housing externally. In the micro USB structure, the connector further includes a protective plate to reduce the RF or electromagnetic interference and the enforce the rigidity of the tongue portion of the insulating housing. In general, the protective plate is bent to form a front portion and two opposite side portions so as to wrap the tongue portion externally.

As the micro USB connector usually needs to be plugged many times, the tongue portion is wrapped through a protective plate made of a metallic material to protect the tongue portion. FIG. 1 is a perspective view of a protective plate of a connector receptacle in the prior art, and it can be seen clearly from FIG. 1 that the protective plate 11 is bent to form a front portion 12 and two opposite side portions 13 so as to protect the tongue portion of the insulating housing from being damaged by external forces.

However, as the front portion 12 and the two opposite side portions 13 of the protective plate 11 are formed through direct bending, a gap 14 is formed between the front portion 12 and each side portion 13. The front portion 12 is connected with the two opposite side portions 13 respectively, and due to this structure the protective plate 11 only can protect the front end and left and right sides of the insulating housing, and the tongue portion at the gap 14 is likely to be damaged by external forces.

Moreover, while the micro USB connector receptacle is connected with a plug, the plug may press the protective plate and the tongue portion of the insulating house, such that protective plate may contact to the power contact. When the protective plate contacts the power contact, short circuit could be caused, and the connector may be overheating and breakdown.

Therefore, how to solve the above conventional problems and defects is the direction in which inventors of the instant disclosure and relevant manufacturers in the industry are anxious to research and improve.

SUMMARY

Hence, the inventors of the instant disclosure, in view of the above defects, design this patent application by collecting related information, through evaluation and consideration by multiple parties, according to accumulated years of experience in engagement in the industry, and through constant attempts and modifications.

An objective of the instant disclosure is to provide a connector receptacle capable of protecting a tongue portion of an insulating housing, enforcing the rigidity of the tongue portion of the insulating housing, and preventing the connector receptacle from short circuit.

To achieve the above objective, the instant disclosure provides a connector receptacle which includes:

an insulating housing including a base portion and a tongue portion extending forward from the base portion, where the tongue portion is plate-shaped and provided;

a plurality of contacts retained in the insulating housing, wherein a power contact exists among the contacts;

a protective plate comprising a planar main portion and two connecting arm portions, wherein the planar main portion is disposed on the tongue portion, and the two connecting arm portions are disposed on the based portion; the planar main portion comprises a planar section, a front section, a side section, and a connecting section; the planar section is disposed on a top surface of the tongue portion, the front section is bent downwardly, extending from a front side of the planar section, and covering the front surface of the tongue portion; the side section is bent downwardly and extending from one of two lateral sides of the planar section; the connecting section is located and connected between one of two sides of the front section and the side section, and the connecting section covers one of corners formed by the meeting of the front surface and the side surfaces of the tongue portion; and the other lateral side of the planar section is a cutting notch exposing a part of the tongue portion which corresponds to the power contact; and a metallic shell wrapping the insulating housing externally.

In a preferred embodiment, the connector receptacle is a micro USB connector receptacle.

In a preferred embodiment, the tongue portion defines a plurality of receiving slots through the base portion, and the contacts are inserted into the receiving slots of the base portion.

In a preferred embodiment, the planar main portion includes a second connecting section covering the other corner formed by meeting of the front surface and the side surfaces of the tongue portion, and the cutting notch extends from the second connecting section to the connecting arm portion.

In a preferred embodiment, the protective plate further includes at least one first opening for exposing the contacts. For example, the protective plate includes two first openings, and the two first opening are separated by a bridge section. The cutting notch extends from the other side of the front section to the bridge section.

In a preferred embodiment, the protective plate further includes at least one second opening for exposing parts of the tongue portion. For example, the second opening is located on the front section. Moreover, the protective plate further includes at least one third opening located on the side section.

In a preferred embodiment, the protective plate includes a plurality of concaves which are located at a wall of the first opening, which is adjacent to the front section.

In the instant disclosure, the protective plate bends to form a front section, a side section, and a connecting section, for wrapping the tongue portion and enforcing the rigidity of the tongue portion, thereby avoiding damage incurred by external forces. In addition, the planar main portion includes a cutting notch corresponding to the power contact, so as to prevent the power contact and the protective plate from contacting while a plug plugging in. Therefore, the short circuit can be avoided and the safety can be secured.

BRIEF DESCRIPTION OF THE DRAWINGS

The instant disclosure will become more fully understood from the detailed description given herein below for illustration only, and thus are not limitative of the instant disclosure, and wherein.

DETAILED DESCRIPTION

To achieve the objectives and effects, and facilitate full understanding of the technical means and construction used in the instant disclosure, the features and functions are described below in detail with reference to the accompanying drawings and preferred embodiments of the instant disclosure.

Figure 1:
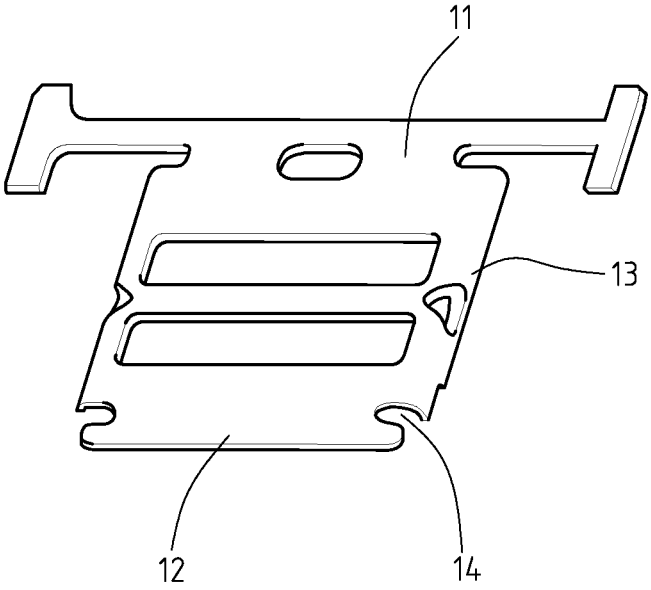
FIG. 1 (Prior Art)
FIG. 1 is a perspective view of a protective plate of a connector receptacle showing that the protective plate includes gaps between a front portion and two side portions thereof in the prior art.
Figure 2:
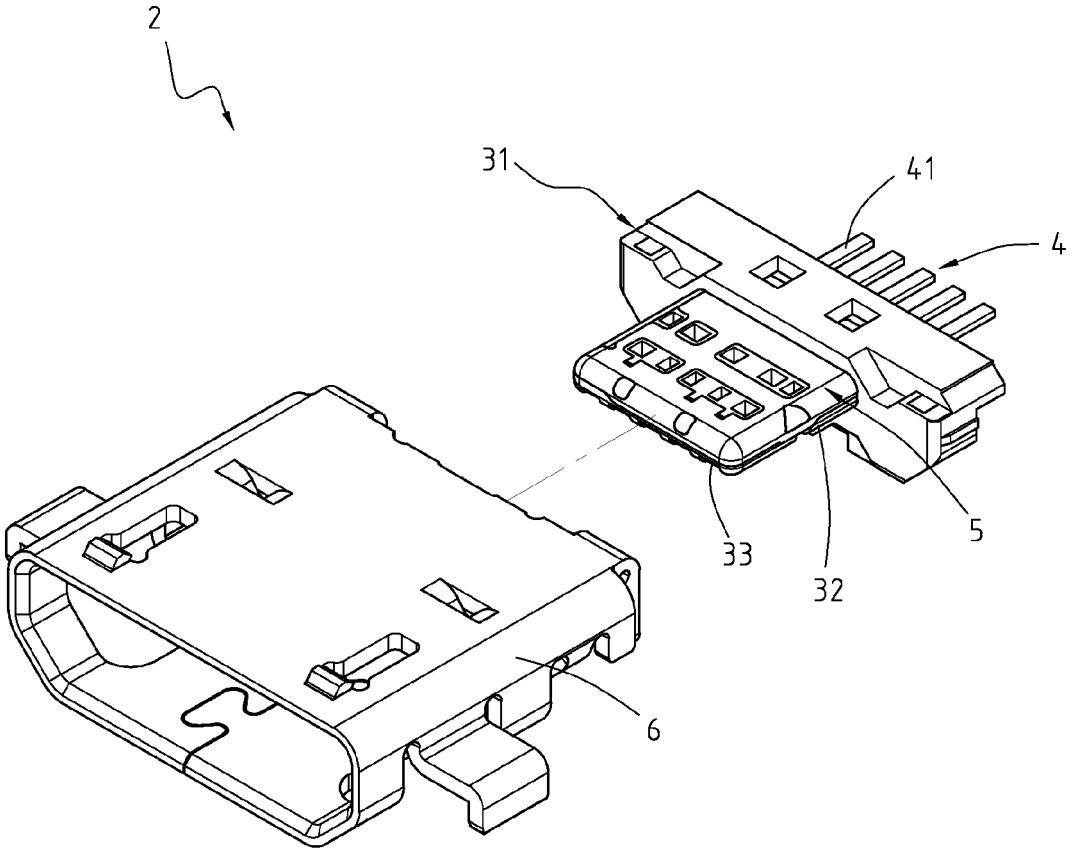
FIG. 2 is a partly exploded perspective view of a connector receptacle formed in a first exemplary embodiment according to the instant disclosure.
Figure 3:
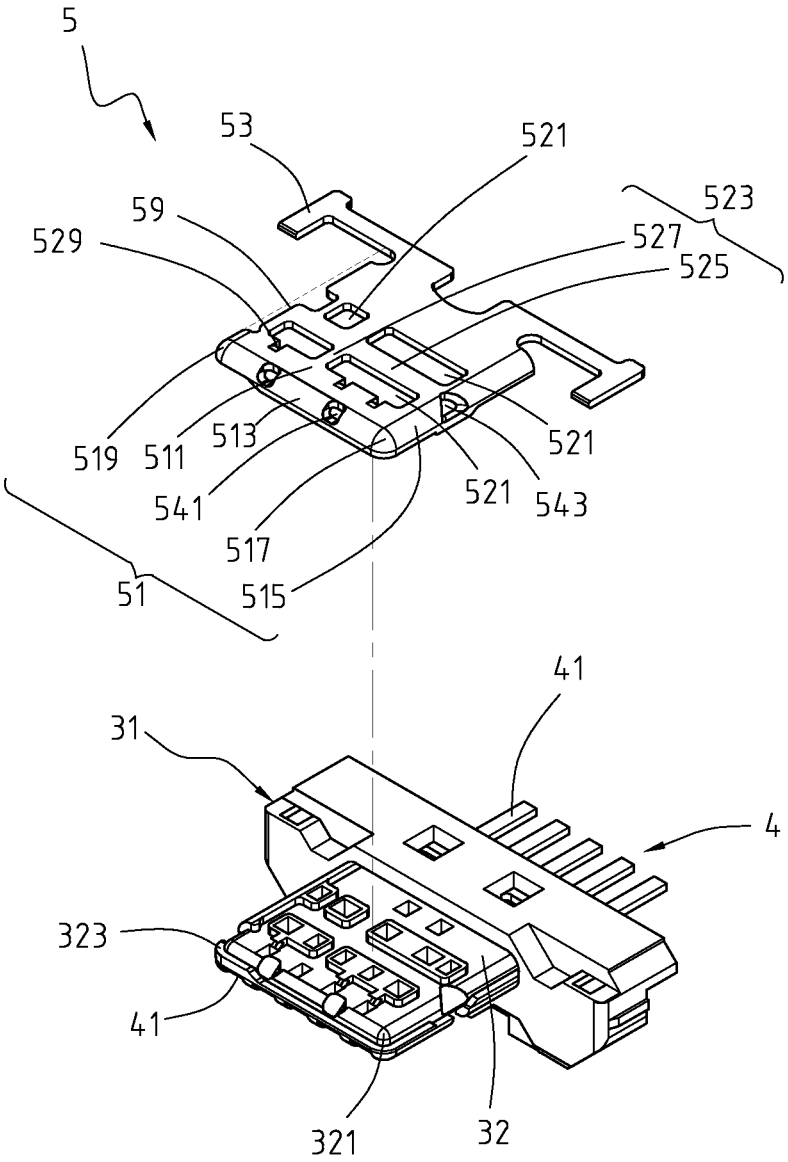
FIG. 3 is a partly exploded perspective view of FIG. 2 formed in the first exemplary embodiment according to the instant disclosure, where the metallic shell is omitted.
Figure 4:
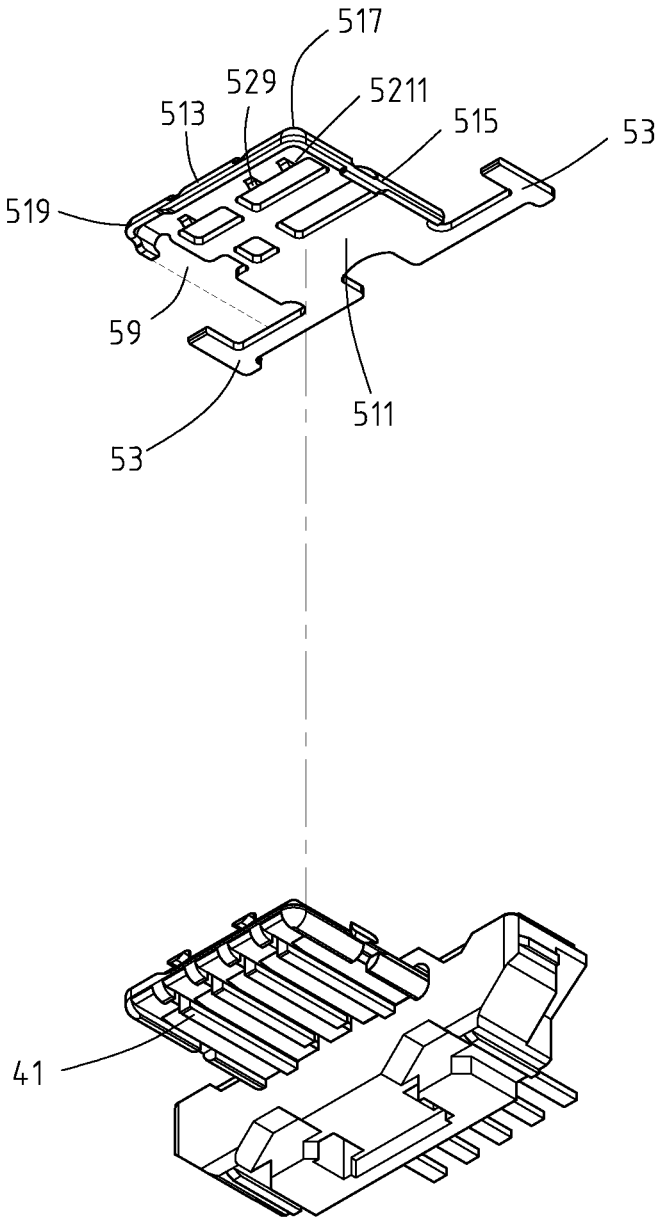
FIG. 4 is another partly exploded perspective view of FIG. 2 formed in the first exemplary embodiment according to the instant disclosure, where the metallic shell is omitted.
Figure 5:
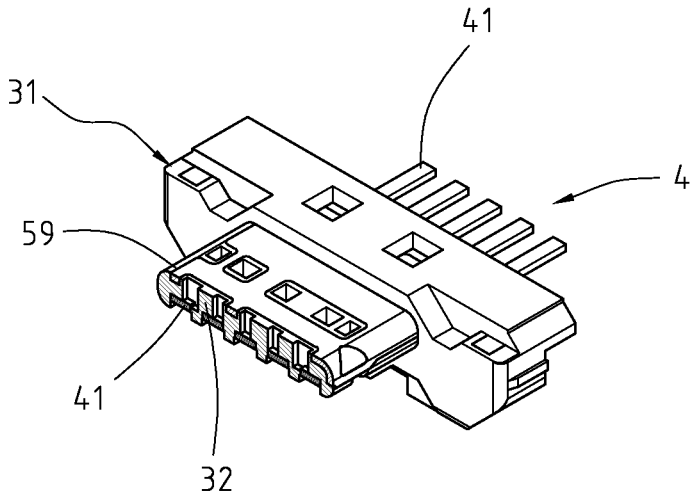
FIG. 5 is a perspective cross-sectional view of the connector receptacle formed in the first exemplary embodiment according to the instant disclosure, where the metallic shell is omitted.

Referring to FIG. 2, FIG. 3, FIG. 4, and FIG. 5, FIG. 2 is a partly exploded perspective view of a connector receptacle formed in a first exemplary embodiment according to the instant disclosure, FIG. 3 is a partly exploded perspective view of FIG. 2 formed in the first exemplary embodiment according to the instant disclosure, where the metallic shell is omitted, FIG. 4 is another partly exploded perspective view of FIG. 2 formed in the first exemplary embodiment according to the instant disclosure, where the metallic shell is omitted, and FIG. 5 is a perspective cross-sectional view of the connector receptacle formed in the first exemplary embodiment according to the instant disclosure, where the metallic shell is omitted. The first exemplary provides a connector receptacle 2 which includes an insulating housing 3, a plurality of contacts 4, a protective plate 5, and a metallic shell 6. In this embodiment, the connector receptacle 2 is a micro USB connector receptacle.

The insulating housing 3 includes a base portion 31 and a tongue portion 32 extending forward from the base portion 31. For example, the tongue portion 32 is plate-shaped and defines a plurality of receiving slots 33 through the base portion 31. The contacts 4 are inserted into the receiving slots 33 of the insulating housing 3 or retained in the base portion 31 by insert-molding technique. A power contact 41 exists among in the contacts 4, in this embodiment, the power contact 41 is located at the left side. The metallic shell 6 wraps the insulating housing 3 externally.

In the first exemplary embodiment according to the instant disclosure, the protective plate 5 is made of a metallic material, and includes a planar main portion 51 and two connecting arm portions 53. The planar main portion 51 is disposed on the tongue portion 32, and the two connecting arm portions 53 are disposed on the based portion 31. The planar main portion 51 comprises a planar section 511, a front section 513, a side section 515, and a connecting section 517. The planar section 511 is disposed on a top surface of the tongue portion 32. The front section 513 is bent downwardly, extending from a front side of the planar section 511, and covering the front surface of the tongue portion 32. The side section 515 is bent downwardly, extending from one of two lateral sides of the planar section 511, and covering one side surface of the tongue portion 32.

The connecting section 517 is located and connected between one of two sides of the front section 513 and the side section 515, and covers a corner 321 of the tongue portion 32 formed by the meeting of the front surface and the side surfaces of the tongue portion 32. The other lateral side of the planar section 511 is a cutting notch 59 for exposing a part of the tongue portion 32 which corresponds to the power contact 41.

In the first exemplary embodiment according to the instant disclosure, The planar main portion 51 includes a second connecting section 519. The second connecting section 519 covers another corner 323 formed by meeting of the front surface and the side surfaces of the tongue portion 32. The cutting notch 59 extends from the second connecting section 519 to the connecting arm portions 53 at the same side of the second connecting section 519. In the first embodiment, most portions of one of two lateral sides of the planar main portion 51 is removed to form the cutting notch 59. Therefore, the power contact 41 and the protective plate 5 do not contact each other while a plug is plugged in the connector receptacle 2.

The planar section 511 further includes at least two first openings 521, and each two of the first openings 521 are separated by a bridge section 523. In the first exemplary embodiment according to the instant disclosure, as shown in FIG. 2-5, the planar main portion 51 comprises four first openings 521, and the first openings 521 are separated by a first bridge section 525 in a lateral direction and a second bridge section 527 in a longitudinal direction. Moreover, The planar main portion 51 includes a plurality of concaves 529 which are located at a wall 5211 of the first openings 521, which are adjacent to the front section 513.

The planar main portion 51 further comprises at least one second opening 541 and at least one third opening 543. The second opening 541 is located on the front section 513, and the third opening 543 is located on the side section 515. The first opening 521, the concave 529, the second opening 541, and the third opening 543 are used to increase the combination of the protective plate 5 and the tongue portion 32 during inserting molding.

Figure 6:
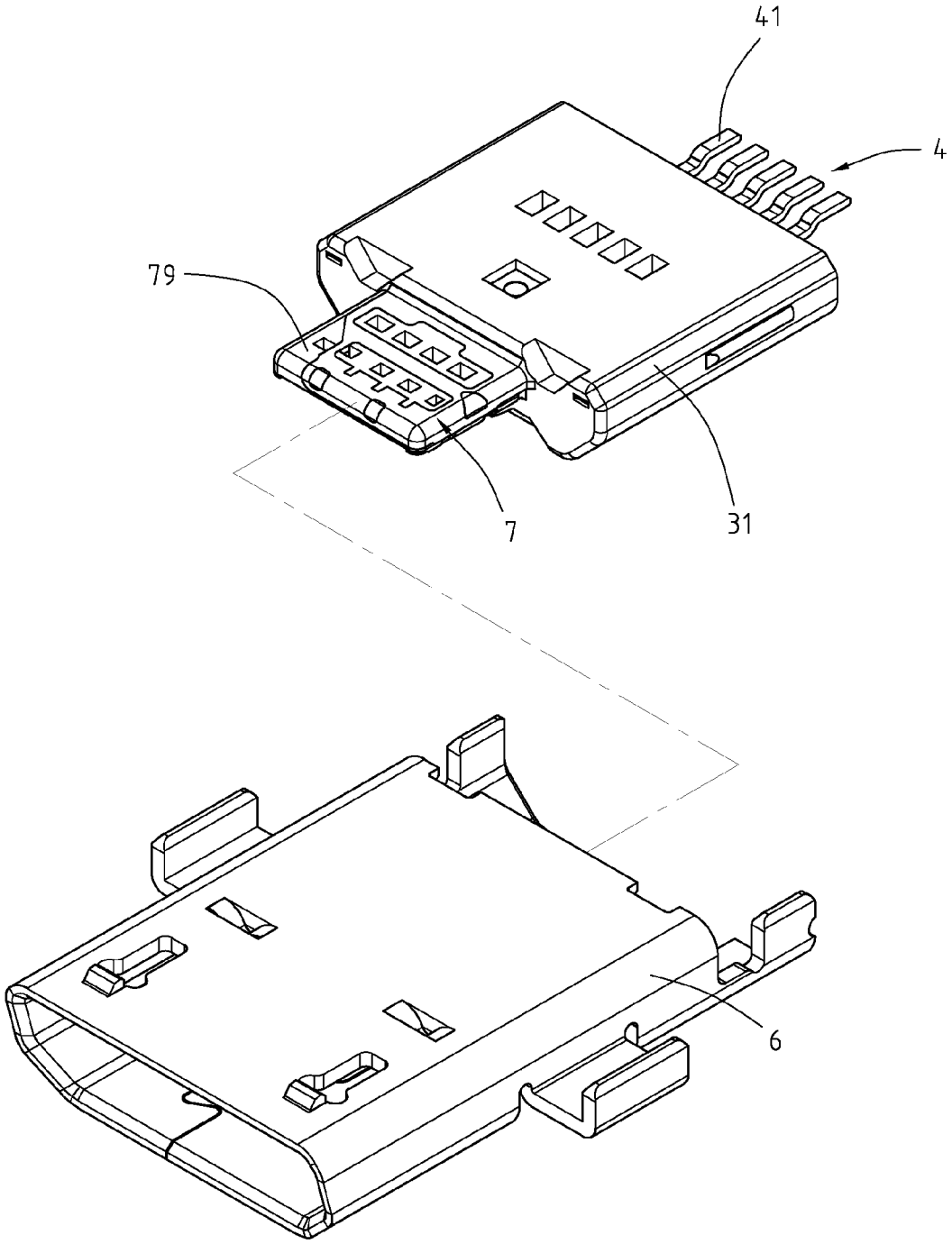
FIG. 6 is a partly exploded perspective view of a connector receptacle formed in a second exemplary embodiment according to the instant disclosure.
Figure 7:
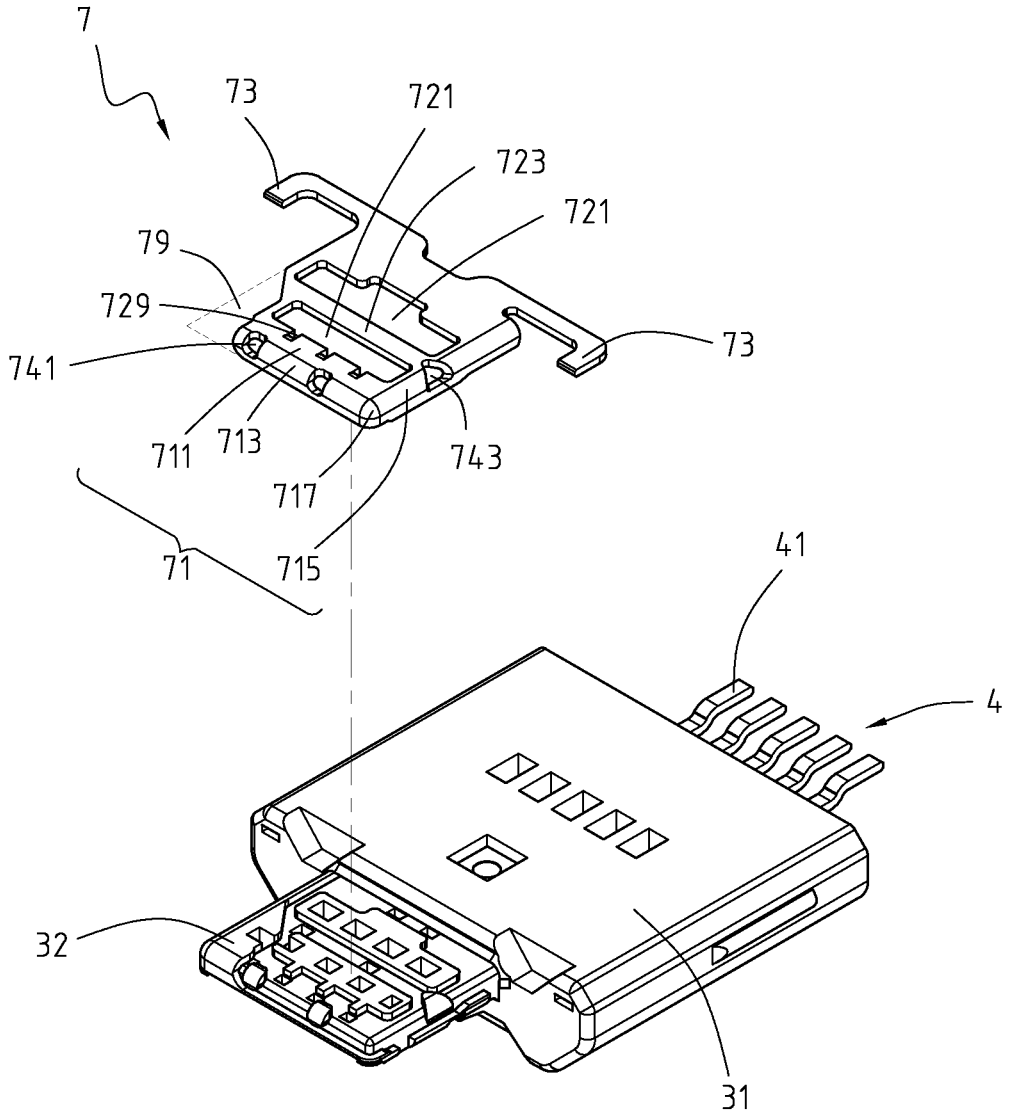
FIG. 7 is a partly exploded perspective view of FIG. 6 formed in the second exemplary embodiment according to the instant disclosure, where the metallic shell is omitted.
Figure 8:
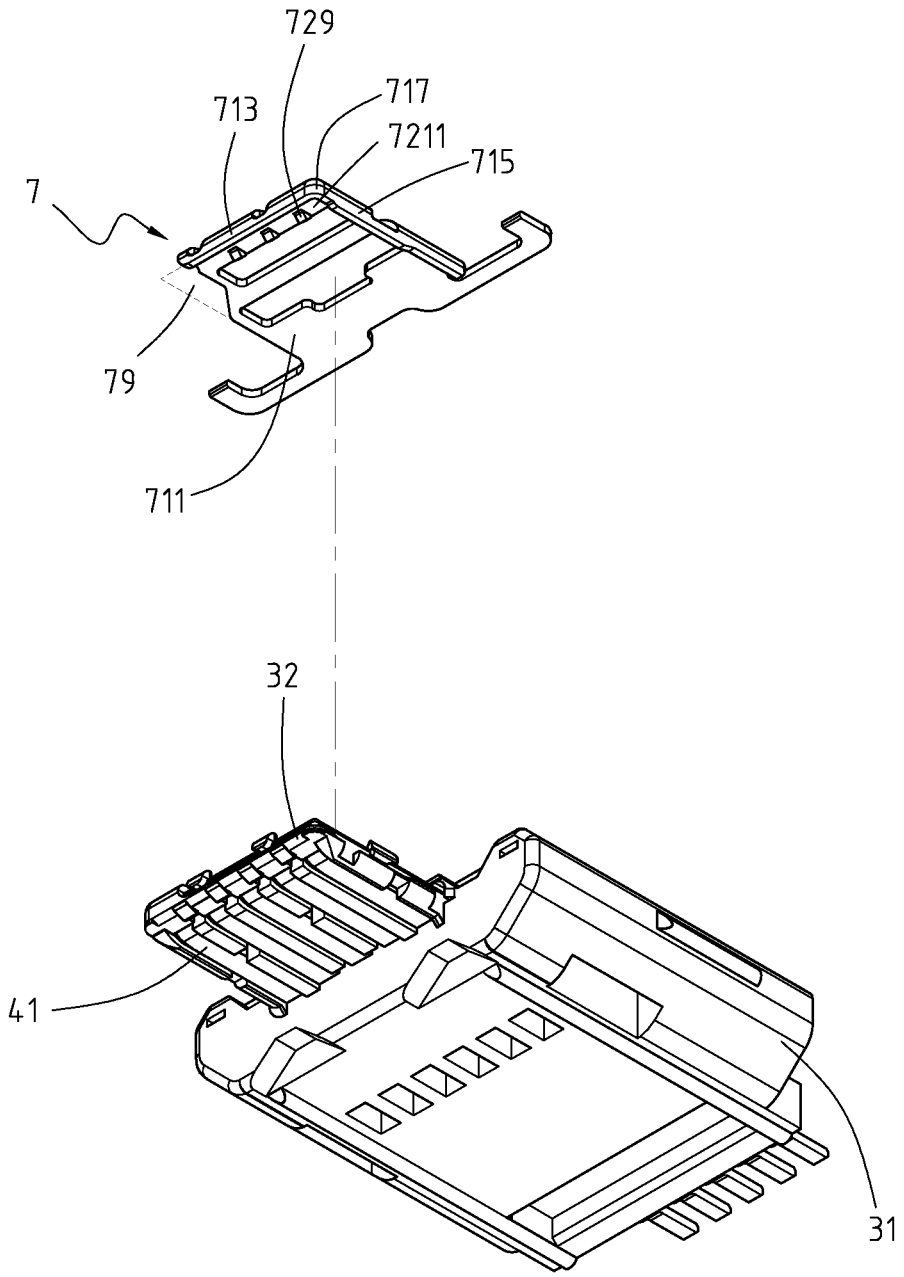
FIG. 8 is another partly exploded perspective view of FIG. 6 formed in the second exemplary embodiment according to the instant disclosure, where the metallic shell is omitted.
Figure 9:
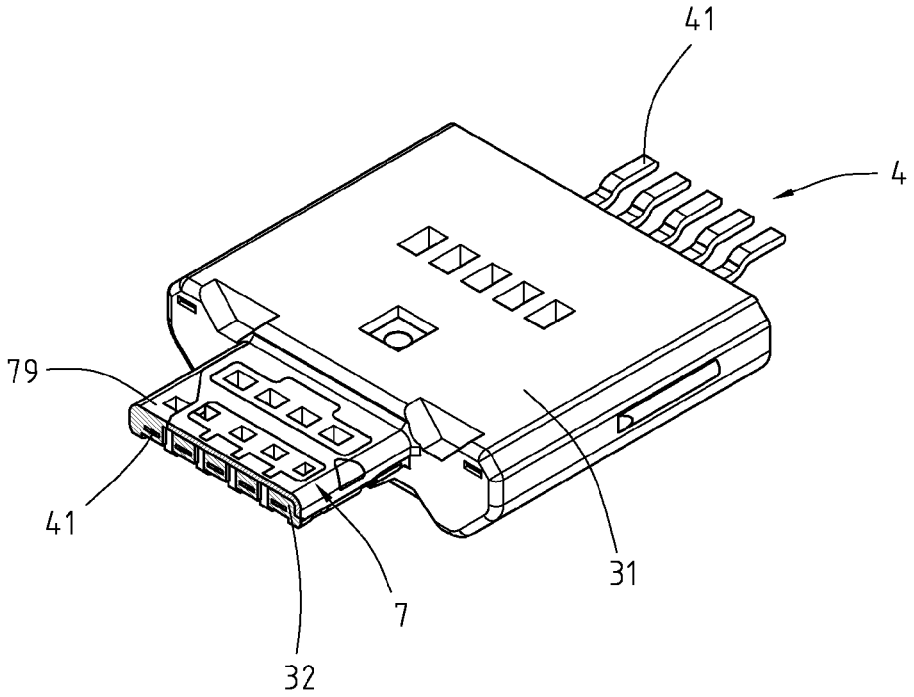
FIG. 9 is a perspective cross-sectional view of the connector receptacle formed in the second exemplary embodiment according to the instant disclosure.

Referring to FIG. 6, FIG. 7, FIG. 8, and FIG. 9, FIG. 6 is a partly exploded perspective view of a connector receptacle formed in a second exemplary embodiment according to the instant disclosure, FIG. 7 is a partly exploded perspective view of FIG. 6 formed in the second exemplary embodiment according to the instant disclosure, where the metallic shell is omitted, FIG. 8 is another partly exploded perspective view of FIG. 6 formed in the second exemplary embodiment according to the instant disclosure, where the metallic shell is omitted, and FIG. 9 is a perspective cross-sectional view of the connector receptacle formed in the second exemplary embodiment according to the instant disclosure. The second exemplary of the instant disclosure provides a connector receptacle 2 which includes an insulating housing 3, a plurality of contacts 4, a protective plate 7, and a metallic shell 6. In the second embodiment, the connector receptacle 2 is a micro USB connector receptacle.

The difference of the second embodiment between of the first embodiment is the structure of the protective plate 7. In the second embodiment, the protective plate 7 is made of a metallic material, and includes a planar main portion 71 and two connecting arm portions 73. The planar main portion 71 is disposed on the tongue portion 32, and the two connecting arm portions 73 are disposed on the based portion 31. The planar main portion 71 comprises a planar section 711, a front section 713, a side section 715, and a connecting section 717. The planar section 711 is disposed on a top surface of the tongue portion 32. The front section 713 is bent downwardly, extending from a front side of the planar section 71, and covering the front surface of the tongue portion 32. The side section 715 is bent downwardly, extending from one of two lateral sides of the planar section 71, and covering one side surface of the tongue portion 32.

The connecting section 717 is located and connected between one of two sides of the front section 713 and the side section 715, and covers a corner 321 of the tongue portion 32 formed by the meeting of the front surface and the side surfaces of the tongue portion 32. The other lateral side of the planar section 71 is a cutting notch 79 for exposing a part of the tongue portion 32 which corresponds to the power contact 41. The planar main portion 71 comprises two first opening 721, and the first opening 721 are separated by a bridge section 723, and the cutting notch 79 extends from the other side of the front section 713 to the bridge section 723. In the second embodiment, the corner of the planar main portion 71 is removed to form the cutting notch 79. Therefore, the power contact 41 and the protective plate 7 do not contact each other while a plug is plugged in the connector receptacle 2.

Moreover, The planar main portion 71 includes a plurality of concaves 729 located at a wall 7211 of the first opening 721, which is adjacent to the front section 713.

The planar main portion 71 further comprises at least one second opening 741 and at least one third opening 743. The second opening 741 is located on the front section 713, and the third opening 743 is located on the side section 715. The first opening 721, the concave 729, the second opening 741, and the third opening 743 are used to increase the combination of the protective plate 7 and the tongue portion 32 during inserting molding.

In the instant disclosure, the protective plate wraps at least one corner of the tongue portion and enforcing the rigidity of the tongue portion, thereby avoiding damage incurred by external forces. In addition, parts of one side of the planar main portion is removed to form a cutting notch. The cutting notch exposes parts of the tongue portion corresponding the power contact, so as to prevent the power contact and the protective plate from contacting while a plug plugging in. Therefore, the short circuit can be avoided and the safety can be secured. Moreover, the planar main portion includes a plurality openings for increasing the combination of the protective plate and the tongue portion during inserting molding.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A connector receptacle comprising:

an insulating housing comprising a base portion and a tongue portion extending forward from the base portion, wherein the tongue portion is plate-shaped and comprises a front surface, a top surface and side surfaces;

a plurality of contacts retained in the insulating housing, the plurality of contacts including a power contact;

a conductive protective plate comprising a planar main portion and two connecting arm portions, wherein the planar main portion is disposed on the tongue portion, and the two connecting arm portions are disposed inside the base portion, the planar main portion comprises a planar section disposed on the top surface of the tongue portion, the planar section having two lateral sides which include one lateral side and an other lateral side, a front section bent downwardly, extending from a front side of the planar section, and covering the front surface of the tongue portion, the front section having two sides including one side and an other side, a side section bent downwardly and extending from the one lateral side of the planar section, and a connecting section located and connected between the side section and the one of the two sides of the front section, and the connecting section covers one of corners formed by meetings of the front surface and one of the side surfaces of the tongue portion, wherein the other lateral side of the planar section has a cutting notch exposing a part of the tongue portion which corresponds to the power contact; and a metallic shell wrapping the insulating housing.

2. The connector receptacle according to claim 1, wherein the tongue portion defines a plurality of receiving slots, the receiving slots extending through the base portion, wherein the contacts are inserted into the receiving slots of the base portion.

3. The connector receptacle according to claim 1, wherein the planar section comprises at least two first openings, and the at least two first openings are separated from each other by a bridge section of the planar section.

4. The connector receptacle according to claim 3, wherein the protective plate comprising a plurality of concaves located at a wall of the at least two first openings, the wall being adjacent to the front section.

5. The connector receptacle according to claim 3, wherein the cutting notch extends from the other side of the front section to the bridge section.

6. The connector receptacle according to claim 1, wherein the planar main portion includes a second connecting section covering another corner formed by a meeting of the front surface and another of the side surfaces of the tongue portion.

7. The connector receptacle according to claim 6, wherein the cutting notch extends from the second connecting section to one of the connecting arm portions disposed at a same side as the second connecting section.

8. The connector receptacle according to claim 1, wherein the planar main portion further comprises at least one second opening located on the front section.

9. The connector receptacle according to claim 1, wherein the planar main portion further comprises at least one third opening located on the side section.

10. The connector receptacle according to claim 1, wherein the connector receptacle is a micro USB connector receptacle.

* * * * *